US007811241B1

(12) United States Patent
Baker

(10) Patent No.: US 7,811,241 B1
(45) Date of Patent: Oct. 12, 2010

(54) METHOD OF USING A THERAPEUTIC PILLOW

(76) Inventor: Mary Baker, 2510 Oakland Dr. West, Norristown, PA (US) 19403

( * ) Notice: Subject to any disclaimer, the term of this patent is extended or adjusted under 35 U.S.C. 154(b) by 528 days.

(21) Appl. No.: 11/805,336

(22) Filed: May 24, 2007

(51) Int. Cl.
*A61H 15/00* (2006.01)
*A61H 11/02* (2006.01)

(52) U.S. Cl. ..... 601/131; 601/132; 601/135; 601/138

(58) Field of Classification Search ..... 601/84, 601/128, 131, 132, 134, 135, 136, 138; 401/201
See application file for complete search history.

(56) References Cited

U.S. PATENT DOCUMENTS 3,066,347 A * 12/1962 Vosbikian et al. ..... 401/201
3,977,796 A * 8/1976 Gillespie et al. ..... 401/8
4,210,134 A 7/1980 Okazaki et al.
4,995,127 A 2/1991 Inagaki
6,024,762 A * 2/2000 Gray ..... 607/109
6,174,297 B1 * 1/2001 Chen ..... 601/128
6,238,413 B1 * 5/2001 Wexler ..... 606/204.15
6,305,040 B1 10/2001 Myler
7,399,285 B2 * 7/2008 Stein ..... 601/15
2003/0144616 A1 * 7/2003 Henderson ..... 601/131
2004/0243035 A1 * 12/2004 Devlin ..... 601/131
2006/0129073 A1 * 6/2006 Payne ..... 601/131
2007/0055187 A1 * 3/2007 Magnone et al. ..... 601/132

* cited by examiner

*Primary Examiner*—Danton DeMille

(57) ABSTRACT

A therapeutic pillow includes a flexible body with mated inner and outer layers. Such an inner layer has an outer perimeter that terminates inwardly of an outer perimeter of the outer layer. The apparatus further includes a plurality of spherical objects removably situated within the body and directly abutting an inner surface of the inner layer. Each of the spherical objects has a unique diameter. The body has right and left ends selectively folded along a centrally registered latitudinal axis registered orthogonal to a longitudinal length of the body wherein the right and left ends are directly engaged in such a manner that the spherical objects are prohibited from escaping beyond the respective outer perimeters of the inner and outer layers during operating conditions.

6 Claims, 7 Drawing Sheets

METHOD OF USING A THERAPEUTIC PILLOW

CROSS REFERENCE TO RELATED APPLICATIONS

This application claims the benefit of U.S. Provisional Application No. 60/747,969, filed May 23, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to pillows and, more particularly, to a therapeutic pillow for providing pain relief to a user neck and back muscles.

2. Prior Art

Cushions and other cushion-like items such as pillows containing kapok, fiber, cotton, down, wool, buckwheat-chaff, sponge and the like are well known. However, such an item is generally accompanied by certain disadvantages such as absorbing and retaining moisture from the exterior to become too wet and warm after a long period of use, and providing an unclean condition that can encourage germs and worms to proliferate. While pillows with cases have an advantage for providing comfort of easy and good sleep, they do not have any noticeable therapeutic effects of promoting blood circulation and curing kinks and sore muscles, effects similar to those that can be brought forth by finger pressure therapy and other physical therapeutic measures applicable to muscles and blood circulation.

One prior art example shows a bed pad, an automobile seat pad, a pillow or a similar cushion-like item having therapeutic effects similar to those of finger pressure therapy, a good airing function, and an improved adaptability to the head or waist of the user is provided. A cushion-like item according to the present invention has a series of continuously arranged bag portions containing a large number of stuffing elements of synthetic resin. In a preferred embodiment, the stuffing elements are hollow and spherical and are connected together vertically and horizontally to order to increase its airing function. Unfortunately, this prior art example is bulky and cumbersome to use, and does not provide a pillow-like quality for comfort.

Another prior art example shows a pillow that provides selective pressure by location and force to a body of a user. By selection of a body member, a location on that body member, and a pressure point thereat, an acupressure pillow may be used for gauging and applying a localized, selective force or pressure at a designated point for a user. For example, headaches have been attributed to various causes including stress, tension, and so forth, all of which may result in involuntary tightening of muscles. Tightening of muscles affects blood flow. Restriction of blood flow may be responsible for certain headache pain. By applying a steady, predictable, reliable, continuing pressure at a designated acupressure location on a member of a body of a user, muscles may be relaxed. An acupressure pillow applies steady pressure, to which the body will become accustomed and relax. The actual continual application of pressure may tend to speed relaxation better than unpredictable motion such as vibration and other techniques used in the art. Unfortunately, this prior art example provides a fixed position of the contact points, and does not allow a user to adjust the contact points based upon specific user desire.

Accordingly, a need remains for a therapeutic pillow in order to overcome the above-noted shortcomings. The present invention satisfies such a need by providing an apparatus that is convenient and easy to use, is lightweight yet durable in design, and provides pain relief to a user neck and back muscles. The pillow provides an effective, easy-to-use method of applying massage therapy to aching muscles. Boasting therapeutic, pressurized capabilities, the easily handled, flexible compress is held securely in place to any injured area, providing consumers with the maximum beneficial results. The user can adjust and position the pillow for maximum relief. The pillow can be used by private individuals as well as health care and exercise facilities. The present invention is simple to use, inexpensive, and designed for many years of repeated use.

BRIEF SUMMARY OF THE INVENTION

In view of the foregoing background, it is therefore an object of the present invention to provide an apparatus for a therapeutic pillow. These and other objects, features, and advantages of the invention are provided by a therapeutic pillow for providing pain relief to a user neck and back muscles.

The apparatus includes a flexible body that has permanently mated inner and outer layers. Such an inner layer has an outer perimeter that effectively terminates inwardly of an outer perimeter of the outer layer, and the outer layer is conveniently formed from pliable material. The inner layer includes an outer surface directly attached to an inner face of the outer layer wherein the outer surface of the inner layer advantageously lies contiguously along the inner face of the outer layer and effectively covers a major surface area thereof. The inner layer further has a thickness greater than a thickness of the outer layer, and is formed from pliable and deformably resilient material.

The apparatus further includes a plurality of spherical objects removably situated within the body and directly abutting an inner surface of the inner layer. Each of such spherical objects is conveniently formed from pliable material and is adjustably positioned along the body during operating conditions, and further has a unique diameter. The inner and outer layers have a uniform thickness along entire respective surface areas such that the spherical objects are evenly distributed along the body during operating conditions.

The body has right and left ends selectively folded along a centrally registered latitudinal axis registered orthogonal to a longitudinal length of the body wherein the right and left ends are directly engaged in such a manner that the spherical objects are effectively prohibited from escaping beyond the respective outer perimeters of the inner and outer layers during operating conditions. The spherical objects become intercalated between the right and left ends and advantageously spaced inwardly from the outer perimeter of the inner layer. The spherical objects are displaced within the outer perimeter of the inner layer during operating conditions. The right and left ends have directly adjoining outer edges and maintain a suitable spatial relationship therebetween such that the spherical objects are effectively prohibited from penetrating between the outer edges of the right and left ends.

In an alternate embodiment, hook-and-loop type fasteners are integrally attached to the inner face of the outer layer and effectively extend along an entire circumference thereof so that the body defines an enclosed cavity isolated from an exterior thereof when the outer perimeter of the outer layer is conjoined together.

A method for providing pain relief to a user neck and back muscles includes the steps of locating an area of a user body that is experiencing pain, providing a flexible body that has permanently mated inner and outer layers wherein the inner layer has an outer perimeter that terminates inwardly of an outer perimeter of the outer layer, placing the body directly against the user body, removably situating a plurality of spherical objects within the body, directly abutting the plurality of spherical objects against an inner surface of the inner layer wherein each of the spherical objects has a unique diameter, selectively folding the right and left ends of the body along a centrally registered latitudinal axis registered orthogonal to a longitudinal length of the body, directly engaging the right and left ends of the body, prohibiting the spherical objects from escaping beyond the respective outer perimeters of the inner and outer layers during operating conditions, pressing inwardly against the outer layer and towards at least one of the plurality of spherical objects, and moving the body along the user body to thereby massage the user muscles.

The spherical objects become intercalated between the right and left ends and spaced inwardly from the outer perimeter of the inner layer, and are displaced within the outer perimeter of the inner layer during operating conditions. The method further includes the steps of conjoining the outer perimeter of the outer layer together along an entire circumference thereof so that the body defines an enclosed cavity isolated from an exterior thereof, and adjustably positioning the spherical objects along the body during operating conditions. The spherical objects are formed from pliable material.

In an alternate embodiment, hook-and-loop type fasteners are integrally attached to the inner face of the outer layer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
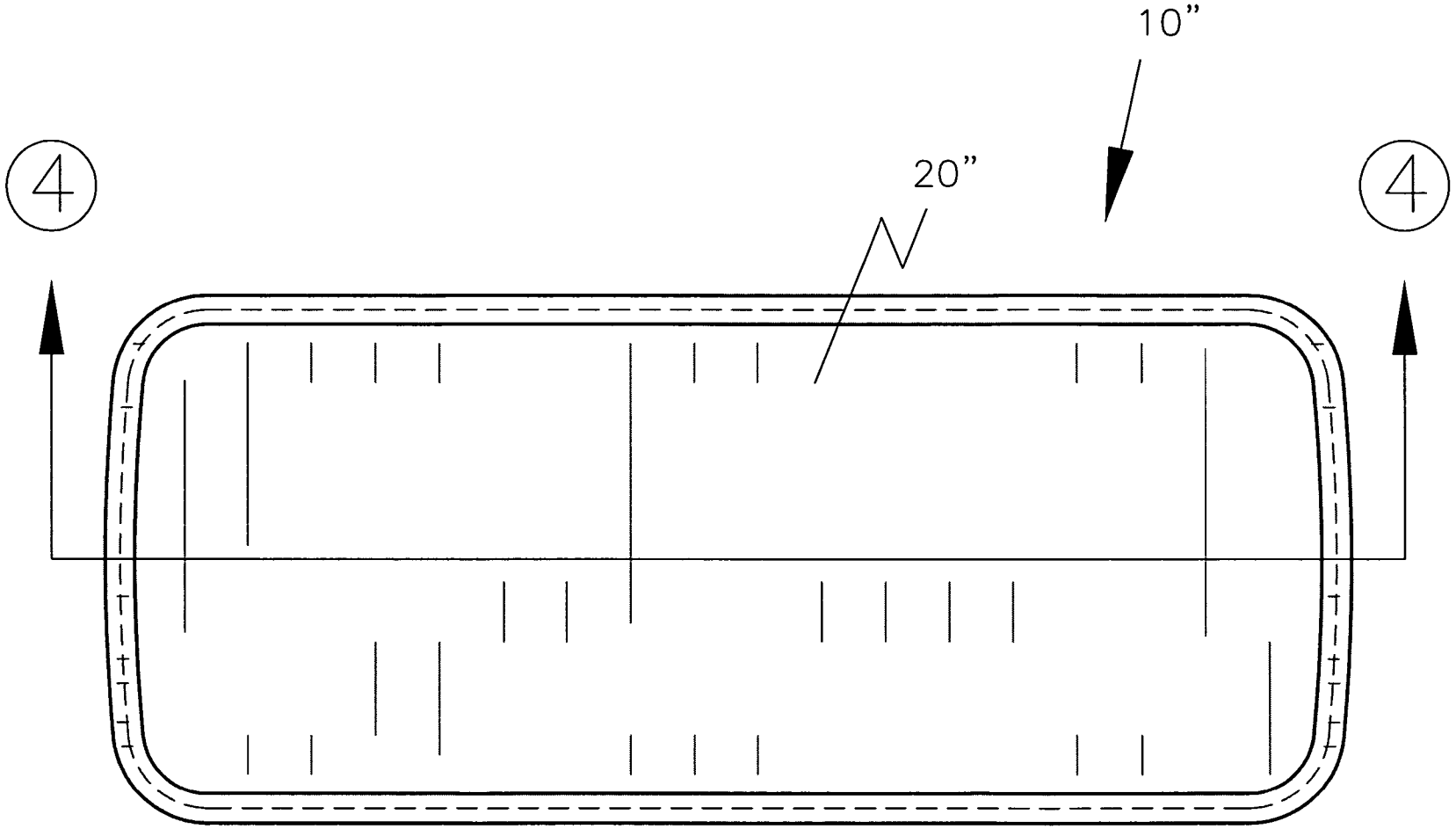
FIG. 1 is a top plan view of a therapeutic pillow, in another embodiment, in accordance with the present invention.
Figure 2:
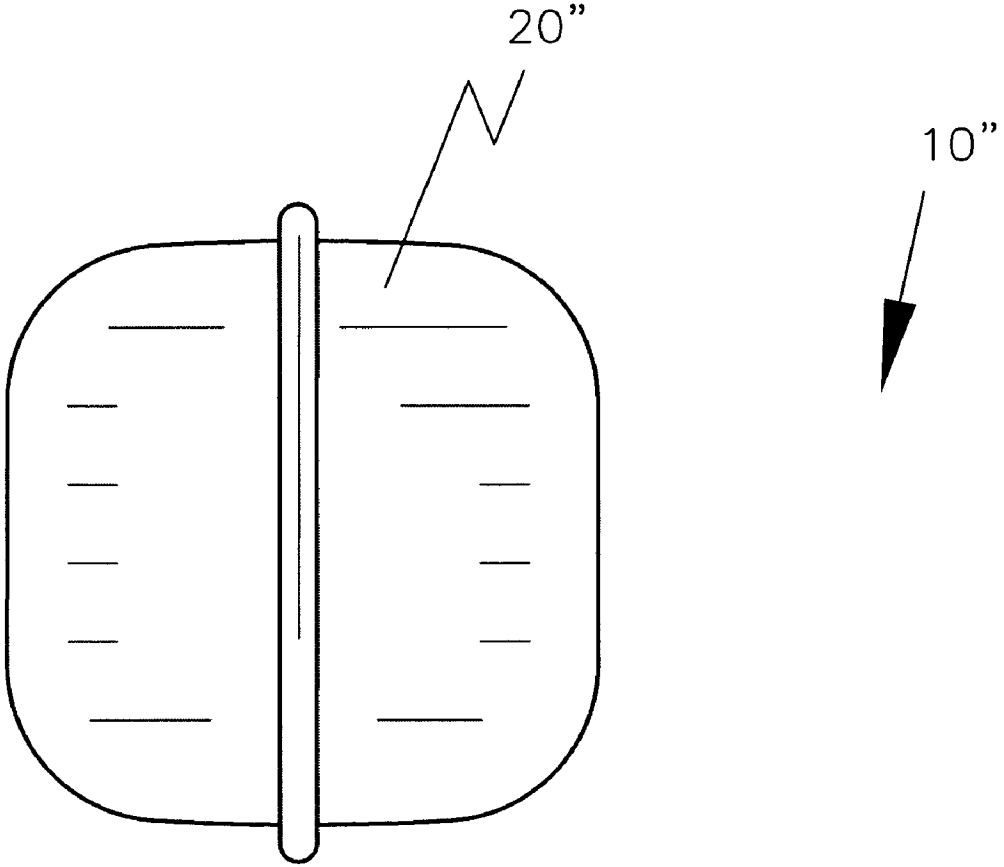
FIG. 2 is a side elevational view of the apparatus shown in FIG. 1.
Figure 3:
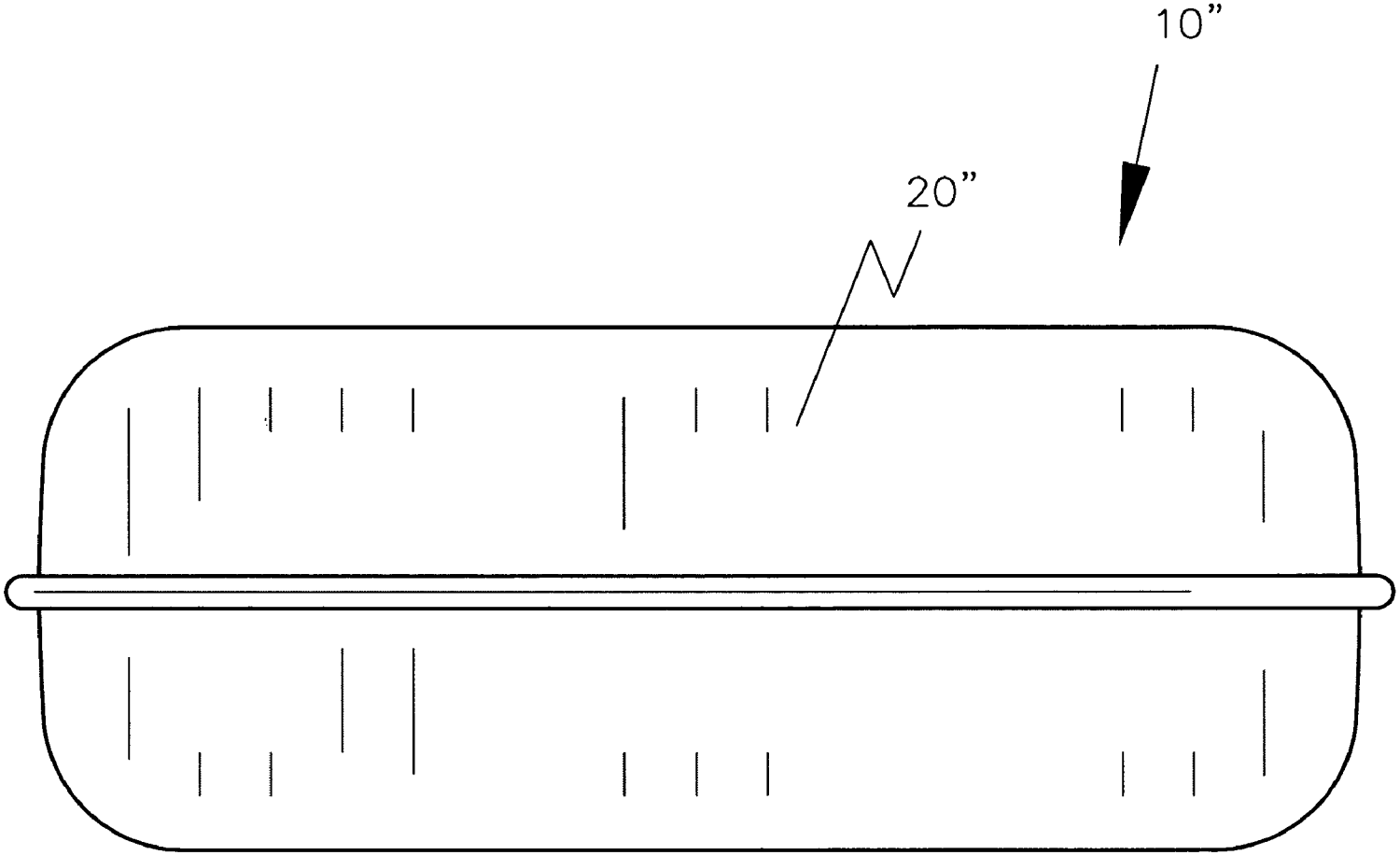
FIG. 3 is a front elevational view of the apparatus shown in FIG. 1.
Figure 4:
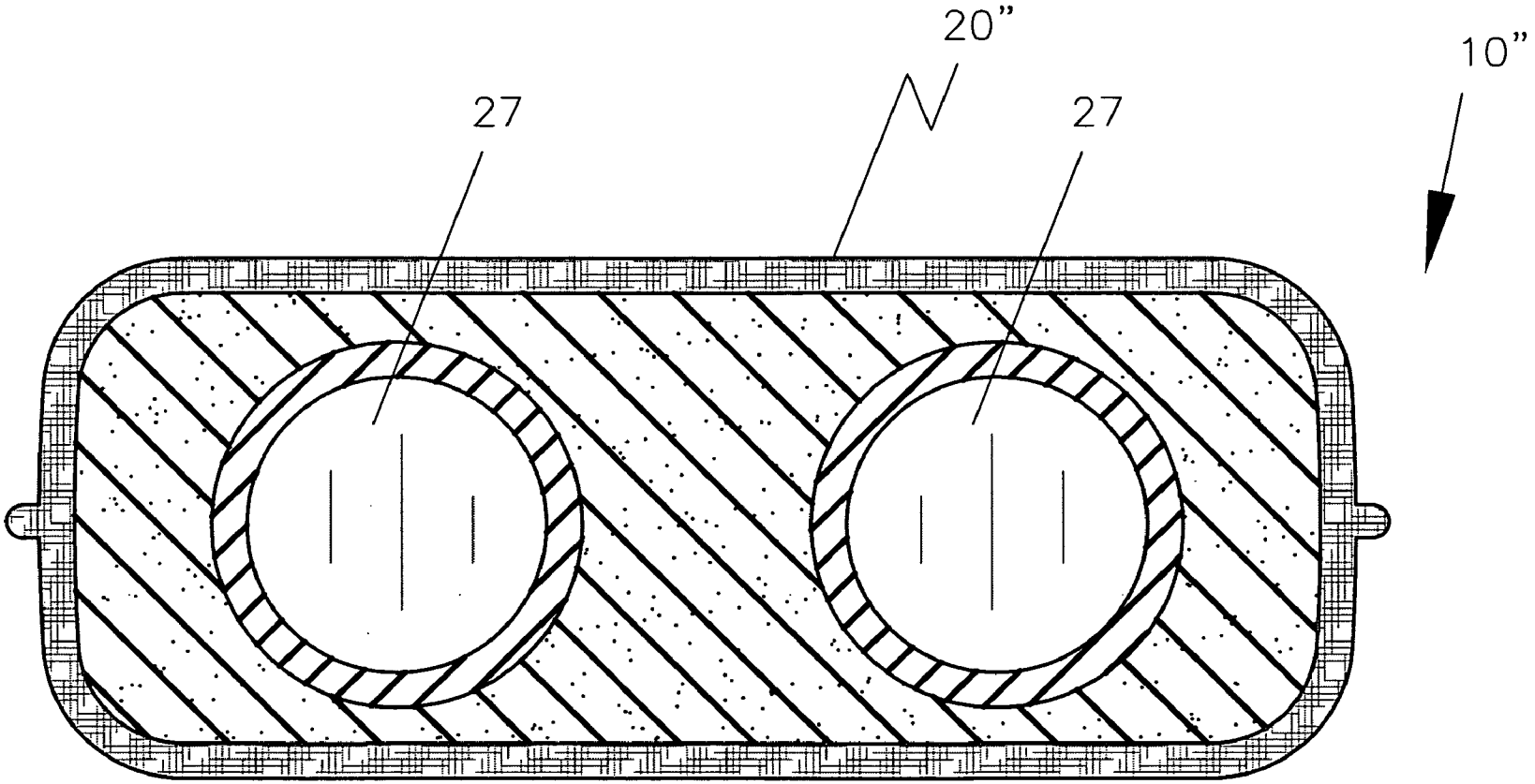
FIG. 4 is a cross sectional view of the apparatus shown in FIG. 1, taken along line 4-4, and showing the spherical objects contained therein.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus and method of this invention are referred to generally in FIGS. 1-7 by the reference numeral 10, 10' and 10" and are intended to provide a therapeutic pillow. It should be understood that the apparatus and method 10, 10' and 10" may be used to provide comfort for many different types of body parts and should not be limited in use to providing only those types of comfort to those types of body parts described herein.

Figure 5:
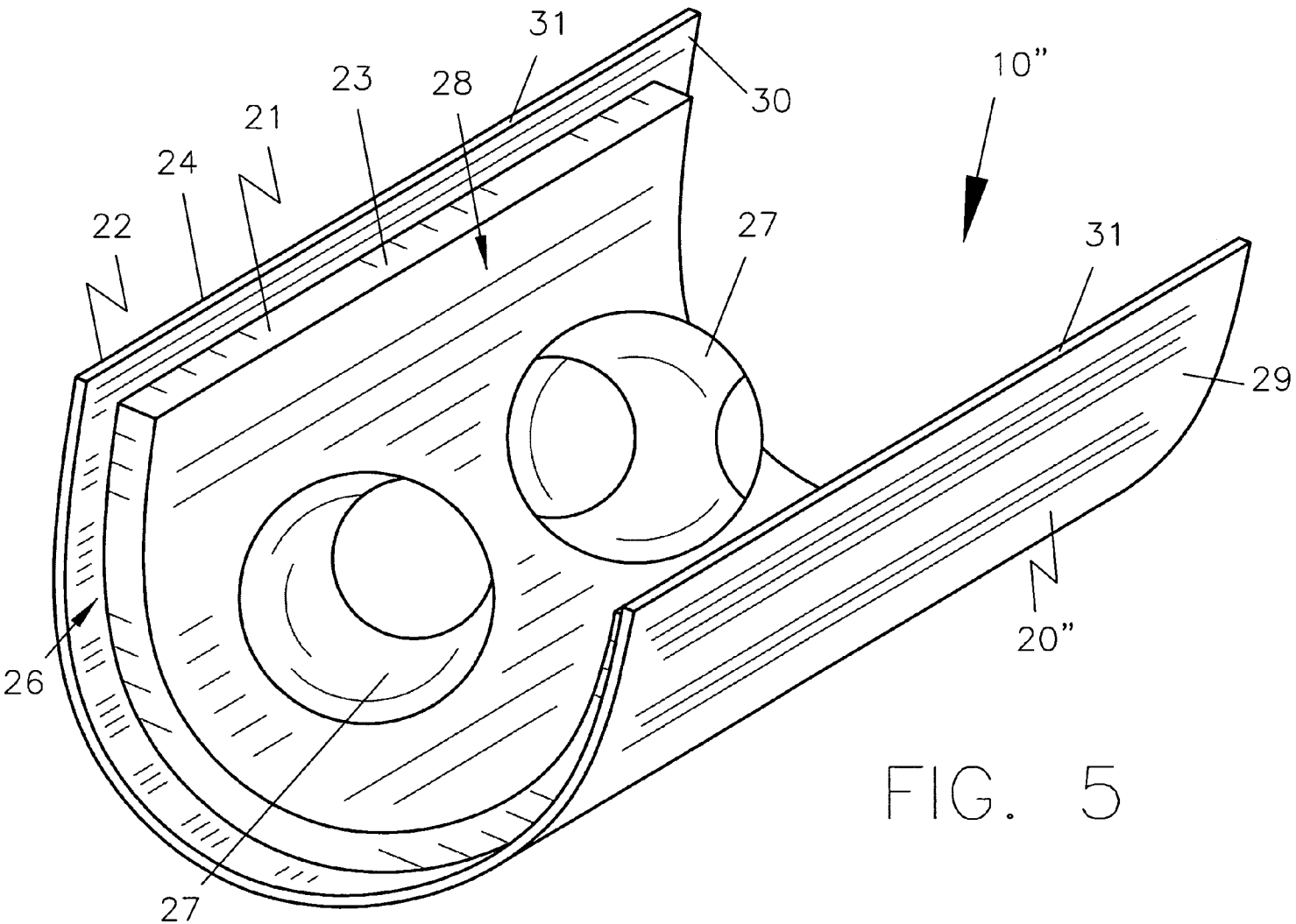
FIG. 5 is a perspective view of the apparatus, in a preferred embodiment, biased to an open position and showing the spherical objects contained therein.
Figure 6:
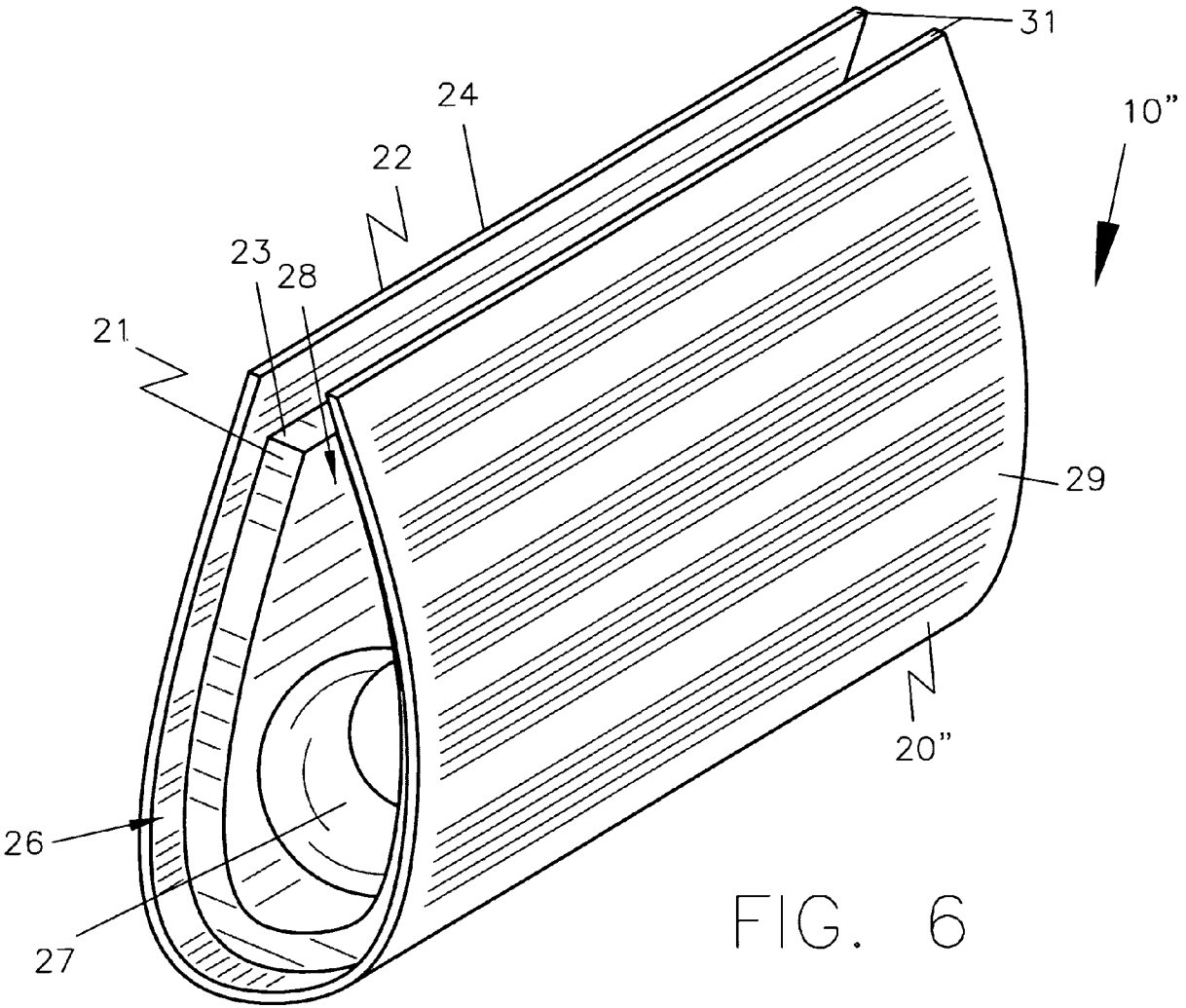
FIG. 6 is a perspective view of the apparatus shown in FIG. 5, showing the apparatus biased to a closed position.

Referring initially to FIGS. 5 and 6, the apparatus 10, in a preferred embodiment, includes a flexible body 20 that has permanently mated inner 21 and outer 22 layers. Such an inner layer 21 has an outer perimeter 23 that terminates inwardly of an outer perimeter 24 of the outer layer 22, and the outer layer 22 is formed from pliable material. The inner layer 21 includes an outer surface directly attached to an inner face 26 of the outer layer 22, without the use of intervening elements, wherein the outer surface of the inner layer 21 advantageously lies contiguously along the inner face 26 of the outer layer 22 and covers a major surface area thereof. The inner layer 21 further has a thickness greater than a thickness of the outer layer 22, and is formed from pliable and deformably resilient material. Such a thickness of the inner layer 21 provides maximum comfort to the user, while the thickness of the outer layer 22 prevents the body 20 from being too bulky for convenient use.

Again referring to FIGS. 5 and 6, the apparatus 10 further includes a plurality of spherical objects 27 removably situated within the body 20 and directly abutting an inner surface 28 of the inner layer 21, without the use of intervening elements. Each of such spherical objects 27 is formed from pliable material and is adjustably positioned along the body 20 during operating conditions, and further has a unique diameter. Such sizing and shaping of each of the spherical objects 27 allows a user to employ the apparatus 10 efficiently to different user body areas, as well as allowing a user of different sizes to enjoy the benefits of the apparatus 10. The inner and outer layers 21, 22 have a uniform thickness along entire respective surface areas, which is essential such that the spherical objects 27 are evenly distributed along the body 20 during operating conditions.

Yet again referring to FIGS. 5 and 6, the body 20 has right 29 and left 30 ends selectively folded along a centrally registered latitudinal axis registered orthogonal to a longitudinal length of the body 20 wherein the right and left ends 29, 30 are directly engaged, without the use of intervening elements, in such a manner that the spherical objects 27 are prohibited from escaping beyond the respective outer perimeters 23, 24 of the inner and outer layers 21, 22 during operating conditions. Such a prohibition maintains the spherical objects 27 within the body 20 and located against a user body. The spherical objects 27 become intercalated between the right and left ends 29, 30 and advantageously spaced inwardly from the outer perimeter 23 of the inner layer 21. Such intercalation of the spherical objects 27 allows a user to manipulate the spherical objects 27 within the body 20 for maximum relief during operating conditions. The spherical objects 27 are displaced within the outer perimeter 23 of the inner layer 21 during operating conditions. The right and left ends 29, 30 have directly adjoining outer edges 31, without the use of intervening elements, and maintain a suitable spatial relationship therebetween such that the spherical objects 27 are prohibited from penetrating between the outer edges 31 of the right and left ends 29, 30.

Figure 7:
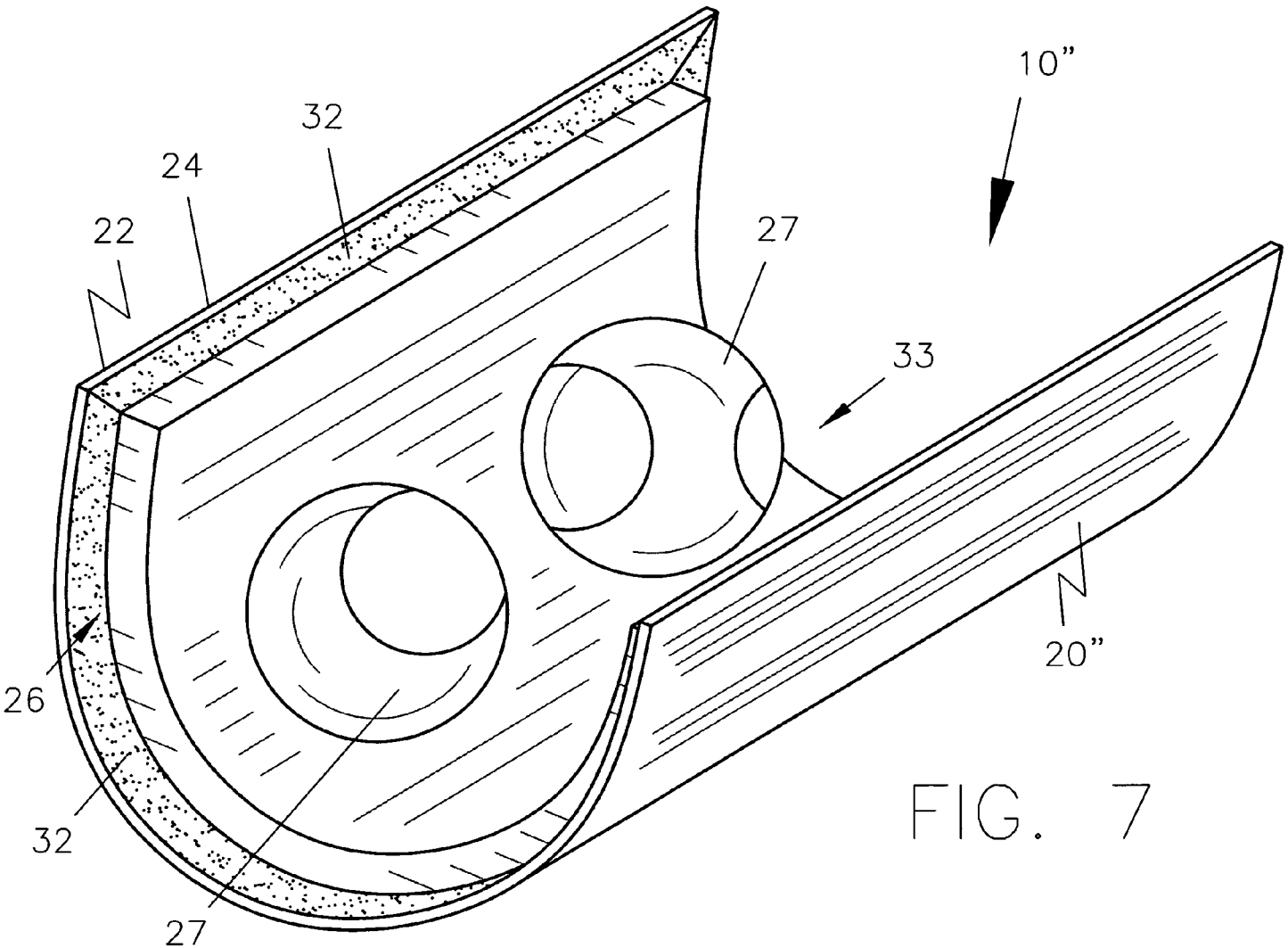
FIG. 7 is a perspective view of the apparatus, in an alternate embodiment, showing hook-and-loop type fasteners.

Referring to FIG. 7, in an alternate embodiment 10', hook-and-loop type fasteners 32 are integrally attached to the inner face 26 of the outer layer 22 and extend along an entire circumference thereof so that the body 20 defines an enclosed cavity 33 isolated from an exterior thereof when the outer perimeter 24 of the outer layer 22 is conjoined together. Such fasteners may also include buttons, snap-closures, tie-loops, or a zipper, as examples. Such isolation of the cavity 33 allows a user to employ the apparatus 10' in a multitude of positions while eliminating the possibility that the spherical objects 27 can become undesirably dislodged and separated from the body 20 during operating conditions.

Referring to FIGS. 1, 2, 3 and 4, in another embodiment 10", the body 20" is a self-contained unit with the spherical objects 27 contained therein. The spherical objects 27 are adjustable and non-removable.

In use, the therapeutic pillow 10 is simple and straightforward to use. First a user locates the area of the user body that is experiencing pain. Then, the user places the apparatus 10 flush against the painful body area. Next, the user presses inwardly on the apparatus 10, against ones of the spherical objects 27, and thereby applies pressure the painful body area. The user then moves the apparatus 10 along the user body allowing the other spherical objects 27 to create a massaging effect and thereby provide relief to the user body.

The fasteners 32 provide the unexpected benefit of allowing a user to employ the apparatus 10 in a variety of positions while eliminating the possibility of dislodging or losing any of the spherical objects 27 during operating conditions. In addition, the removability of the spherical objects 27 from the body 20 allows a user to employ different sizes of spherical objects 27 as desired. All of these benefits overcome the prior art shortcomings.

A method 10 for providing pain relief to a user neck and back muscles includes the steps of locating an area of a user body that is experiencing pain, providing a flexible body 20 that has permanently mated inner 21 and outer 22 layers wherein the inner layer 21 has an outer perimeter 23 that terminates inwardly of an outer perimeter 24 of the outer layer 22, placing the body 20 directly against the user body, without the use of intervening elements, removably situating a plurality of spherical objects 27 within the body 20, directly abutting the plurality of spherical objects 27 against an inner surface 28 of the inner layer 21, without the use of intervening elements, wherein each of the spherical objects 27 has a unique diameter, selectively folding right 29 and left 30 ends of the body 20 along a centrally registered latitudinal axis registered orthogonal to a longitudinal length of the body 20, directly engaging the right and left ends 29, 30 of the body 20, without the use of intervening elements, prohibiting the spherical objects 27 from escaping beyond the respective outer perimeters 23, 24 of the inner and outer layers 21, 22 during operating conditions, pressing inwardly against the outer layer 22 and towards at least one of the plurality of spherical objects 27, and moving the body 20 along the user body to thereby massage the user muscles.

The spherical objects 27 become intercalated between the right and left ends 29, 30 and spaced inwardly from the outer perimeter 23 of the inner layer 21, and are displaced within the outer perimeter 23 of the inner layer 21 during operating conditions. The method 10 further includes the steps of conjoining the outer perimeter 24 of the outer layer 22 together along an entire circumference thereof so that the body 20 defines an enclosed cavity 33 isolated from an exterior thereof, and adjustably positioning the spherical objects 27 along the body 20 during operating conditions. The spherical objects 27 are formed from pliable material.

In an alternate embodiment 10', fasteners 32 are integrally attached to the inner face 26 of the outer layer 24, and extend along the entire circumference thereof. In another embodiment, the body is a self-contained unit with the spherical objects contained therein. The spherical objects are adjustable and non-removable.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A method for providing pain relief to a user neck and back muscles, said method comprising the steps of:

a. locating an area of a user body that is experiencing pain;

b. providing a flexible body having permanently mated inner and outer layers, said inner layer having an outer perimeter that terminates inwardly of an outer perimeter of said outer layer;

c. placing said flexible body directly against the user body;

d. removably situating a plurality of spherical objects within said flexible body;

e. directly abutting said plurality of spherical objects against an inner surface of said inner layer, wherein each of said spherical objects has a unique diameter;

f. selectively folding right and left ends of said flexible body along a centrally registered latitudinal axis registered orthogonal to a longitudinal length of said flexible body;

g. directly engaging said right and left ends of said flexible body;

h. prohibiting said spherical objects from escaping beyond said respective outer perimeters of said inner and outer layers during operating conditions;

i. pressing inwardly against said outer layer and towards at least one of said plurality of spherical objects; and j. moving said flexible body along the user body to thereby massage the user muscles;

wherein said spherical objects become intercalated between said right and left ends and spaced inwardly from said outer perimeter of said inner layer;

wherein said spherical objects being displaced within said outer perimeter of said inner layer during operating conditions.

2. The method of claim 1, wherein said outer layer comprises:

an outer face formed from pliable material;

said inner and outer layers having a uniform thickness along entire respective surface areas such that said spherical objects are evenly distributed along said flexible body during operating conditions.

3. The method of claim 1, wherein said inner layer comprises:

an outer surface directly attached to said inner face of said outer layer, said outer surface of said inner layer lying contiguously along said inner face of said outer layer and covering a major surface area thereof, said inner layer further having a thickness greater than a thickness of said outer layer, said inner layer being formed from pliable and deformably resilient material.

4. The method of claim 1, said right and left ends of said flexible body having directly adjoining outer edges and maintaining a suitable spatial relationship therebetween such that said spherical objects are prohibited from penetrating between said outer edges of said right and left ends.

5. The method of claim 1, further comprising the steps of:

k. folding said outer perimeter of said outer layer along an entire circumference thereof so that said flexible body defines an enclosed cavity isolated from an exterior thereof, hook-and-loop type fasteners being integrally attached to said inner face of said outer layer.

6. The method of claim 1, further comprising the steps of:

l. adjustably positioning said spherical objects along said flexible body during operating conditions, said spherical objects being formed from pliable material.

* * * * *